US006871679B2

(12) United States Patent
Last

(10) Patent No.: US 6,871,679 B2
(45) Date of Patent: Mar. 29, 2005

(54) BAG AND DISPENSING SYSTEM COMPRISING SUCH A BAG

(75) Inventor: Laurens Last, Monte Carlo (MC)

(73) Assignee: IPN IP B.V. (NL)

( * ) Notice: Subject to any disclaimer, the term of this patent is extended or adjusted under 35 U.S.C. 154(b) by 32 days.

(21) Appl. No.: 10/398,018

(22) PCT Filed: Sep. 25, 2001

(86) PCT No.: PCT/NL01/00704

§ 371 (c)(1),
(2), (4) Date: Sep. 12, 2003

(87) PCT Pub. No.: WO02/24585

PCT Pub. Date: Apr. 4, 2002

(65) Prior Publication Data

US 2004/0045632 A1 Mar. 11, 2004

(30) Foreign Application Priority Data

Sep. 28, 2000 (NL) ..... 1016292

(51) Int. Cl.[7] ..... B65B 1/04

(52) U.S. Cl. ..... 141/329; 141/10; 141/114; 141/346; 141/350; 251/149.1; 137/614.05

(58) Field of Search ..... 141/2, 10, 18, 141/114, 313, 314, 329, 330, 346–355; 251/149.1; 137/613, 614.05; 383/42, 200–203

(56) References Cited

U.S. PATENT DOCUMENTS 4,201,208 A * 5/1980 Cambio, Jr. ..... 604/411
4,445,551 A 5/1984 Bond et al.
5,609,195 A * 3/1997 Stricklin et al. ..... 141/346

FOREIGN PATENT DOCUMENTS

| | | |
|---|---|---|
| EP | 0026055 A1 | 4/1981 |
| EP | 0905044 A2 | 3/1999 |
| WO | WO 98/48203 | 10/1998 |
| WO | WO 99/05446 | 2/1999 |
| WO | WO 00/66448 | 11/2000 |

* cited by examiner

*Primary Examiner*—Timothy L. Maust
(74) *Attorney, Agent, or Firm*—Hoffmann & Baron, LLP

(57) ABSTRACT

A bag with a flexible wall which delimits a closed chamber of the bag for a store of a substance, for example a liquid, gaseous, pasty or pulverulent substance, for example a bag with a wall made from single-layer or multilayer (plastic) sheet material.

A female element with a body through which a bore extends is attached to the inner side of the wall, which bore extends from an insertion opening for a male element, which is covered in a sealed manner by the wall of the bag, in the vicinity of the wall of the bag, to an opening in the chamber of the bag.

At a distance from the insertion opening, the bore is also closed off by a closure element, in such a manner that a male element can puncture that part of the wall of the bag which covers the insertion opening from the outside, so that the male element then enters the bore in the female element and—as the male element is inserted further into the bore—then interacts with the closure element and eliminates the closure of the bore which is produced by the closure element.

16 Claims, 3 Drawing Sheets

BAG AND DISPENSING SYSTEM COMPRISING SUCH A BAG

CROSS-REFERENCE TO RELATED APPLICATIONS

This application is the national stage filing under 35 U.S.C. §371 of PCT/NL01/00704, filed Sep. 25, 2001, which claims priority to NL 1016292, filed Sep. 28, 2000, both of which are incorporated herein by reference.

FIELD OF THE INVENTION

The present invention relates to a bag with a flexible wall which delimits a closed chamber of the bag for a store of a substance, for example a liquid, gaseous, pasty or pulverulent substance, for example a bag with a wall made from single layer or multilayer (plastic) sheet material. In this case, the substance may already be present in the bag, but the invention also relates to an empty bag which is subsequently filled with a substance.

BACKGROUND OF THE INVENTION

It is generally known from the prior art to package substances, such as for example drinks, creams, etc. in closed bags. The quality of the substance can be maintained by the hermetical seal from the outside world, which is provided by the wall of the bag. This wall may, for example, comprise single-layer or multilayer sheet material, in many cases comprising a plastic sheet. In order for it to be possible to dispense the substance back out of the bag, a connection between the outside world and the chamber in the bag has to be created in one way or another.

A known way of obtaining this connection is for a male element, for example a straw, to puncture the wall of the bag, so that the substance can be delivered from the bag via the straw. One example of this arrangement is described in U.S. Pat. No. 5,425,583. In this known bag, an opening is made in the wall as early as during production of the bag, and this opening is covered by a membrane of puncturable sheet which is attached to the wall of the bag.

In practice, the known bag has been found to have a number of drawbacks. For example, the bag is difficult to produce, since the puncturable membrane has to be fitted in a separate step and it is also necessary to ensure that the puncturable membrane is hermetically sealed to the wall of the bag. Furthermore, the puncturable membrane is not of the same quality as the rest of the wall of the bag, which detracts from the protection which the bag offers the substance. Another disadvantage is that when the membrane is punctured there is not a neat opening into which the straw fits in a sealed manner. In practice, leaks may easily occur along the outer side of the straw.

With this type of bag, there is also the risk, particularly in the case of relatively small bags, that not only the membrane but also the wall of the bag behind it will be punctured, resulting in an undesired leak in the bag. A further drawback is that when the membrane is punctured the substance will immediately emerge to the outside, certainly if the bag is being held firmly and squeezed.

Bags of other designs are also known from the prior art, in which a female element is secured in an opening in the wall of the bag or in a seam of the bag, with a bore which extends between the outside world and the chamber inside the bag. In these bags, there is also a plug for closing off the bore in the female element. A bag of this type is known, for example, from EP 0 749 358 and from WO 95/30856. A problem with these bags is that as long as the male element remains uncoupled to the female element, i.e. for example during transport and storage of the optionally filled bags, contamination may enter the bore of the female element from the outside.

OBJECTS OF THE INVENTION

One object of the present invention is to provide an improved bag and a dispensing system having a bag of this type.

A further object is to provide a bag which is easy to produce at relatively low cost.

Another object is to provide a bag and dispensing system which complies with the high demands imposed in connection with bacteria.

Yet another object is to provide a bag which is reclosable.

Furthermore, the invention aims to provide a bag which is easy to use and which offers the user a clear indication that the contents have not been tampered with, known as the "first user seal" function.

The invention also relates to a dispensing system comprising a bag of this type and, in combination with this bag, a male element.

The invention also relates to the production of a bag of this type and to the filling of a bag of this type.

SUMMARY OF THE INVENTION

The first aspect of the invention provides a bag which is characterized in that a female element with a body through which a bore extends is attached to the inner side of the wall of the bag, which bore extends from an insertion opening for a male element, which is covered in a sealed manner by the wall of the bag, in the vicinity of the wall of the bag, to an opening into the chamber of the bag, the bore also being closed off, at a distance from the insertion opening, by a closure element, in such a manner that a male element can puncture that part of the wall of the bag which covers the insertion opening from the outside, so that the male element then enters the bore of the female element and—as the male element is inserted further into the bore—then interacts with the closure element and eliminates the closure of the bore which is provided by the closure element.

In one possible embodiment, the closure element is designed to give way under the influence of the male element being inserted into the bore. By way of example, the closure element is a puncturable or tearable membrane, which is optionally integral with the body of the female element. The membrane could be arranged over the inner opening of the bore and could be fixed to the female element, for example by welding, all the way around.

In a preferred embodiment, the closure element is a plug which is accommodated in a sealed manner in a seat which extends around the bore and is delimited by the female element, which plug, under the influence of the male element being fitted into the bore, can be moved out of the associated seat into an open position in which the bore is open.

The bag according to the invention may, for example, be filled in a known way, via a part which has been left open in a welded or glued seam of the bag, which open part is then hermetically sealed after the filling has taken place. The result is a bag which is filled with the substance and the chamber of which is completely protected from the outside world, on the one hand by means of the material of the wall of the bag which covers the insertion opening of the bore and on the other hand by means of the closure element, which closes off the bore again further toward the inside.

When the male element punctures the wall, there is then no risk of the substance passing directly to the outside, since the closure element is still closing off the bore. Only when the male element is inserted further into the bore and the sealing action of the closing element is eliminated under the influence of this movement can the substance emerge from the bag.

Arranging the female element on the inner side of the wall of the bag can be achieved in a relatively simple manner, for example by using a known horizontal or vertical form-fill and seal machine.

Particularly preferably, the plug is also coupled to the body of the female element in its open position, for example via sliding guidance members for the plug which are formed on the body of the female element and extend substantially in line with the bore in the female element, or, for example; via flexible arms which integrally connect the plug to the body of the female element. This ensures that the plug does not pass into the interior of the bag as a loose component.

The invention also provides for the bag filled with the substance to be made available to the user in a state in which the wall of the bag has already been punctured at the location of the insertion opening for the male element and the plug is closing off the axial bore. In this case too, the bag according to the invention offers an advantage, since it is often the case that the prefabricated bags are sterilized before being filled with the substance. In this case, the sterilization is carried out using, for example, gamma radiation. By sterilizing the empty bag in the state in which the wall of the bag is intact and the axial bore is closed off on the outer side by the said wall, it is possible to ensure that there can be no contamination of the axial bore in the period between the sterilization of the empty bag and the filling of the bag (preferably under sterile conditions).

The second aspect of the invention provides a dispensing system comprising, in combination, a bag according to the invention as described above and a male element which, from the outside, can puncture that part of the wall which covers the insertion opening and then enters the bore, and then interacts with the closure element in order to eliminate the closure of the bore provided by the closure element, so that a connection is created to the chamber of the bag.

Preferably, the male element is provided with one or more internal passages for the substance which is to be dispensed, in which case the male element and the female element are designed in such a manner that—when the male element is inserted—a seal is produced between the male element and the female element before the closure of the bore provided by the closure element is eliminated. This avoids any risk of leakage between the male element and the female element, so that the substance can only pass via the one or more passages in the male element. It should be noted that, in the context of this idea, the male element will serve in particular to dispense the substance from the bag, but also, as described above, the male element may serve as a filling member for filling the bag with the substance or for adding an additional substance, for example water, to the substance which is already present in the bag.

If the bore in the female element is closed off with the aid of a plug, the head of the male element and the plug may be designed in various ways in order, in this way, to obtain various manners of interaction between the said components. In one possible variant, the male element can only press the plug out of its seat and can no longer return the plug to its seat. In this case, it is possible for the plug to be coupled to the male element in such a manner that the plug remains on the head of the male element in the open position.

In a preferred embodiment, there is provision for the male element to have a head which can puncture that part of the wall which covers the insertion opening, and for the plug and the head of the male element to be designed in such a manner that the plug can be coupled to the head of the male element, so that the plug on the one hand can be pressed off its seat and on the other hand can also be returned to its seat, so that the bag is reclosable.

The coupling between the head and the plug may be permanent, so that a coupling, once it has been produced, can no longer be undone, but may also be releasable. In the latter version, the male element and the plug are uncoupled after the plug has been returned from its open position to its seat. Particularly in the case of the permanent coupling, it is possible for the bag to be placed in a piece of equipment with a mechanism which engages on the male element in order in each case to remove the plug from its seat or return it to its seat.

In a preferred embodiment, the male element has a sharp point, cutting edge or one or more cutting elements which can be used to puncture that part of the wall which covers the insertion opening.

If the wall of the bag is transparent, it is easy for the user to see where a suitable male element is to puncture the wall of the bag. If the wall of the bag is not transparent, it is possible for the wall to be printed or to have some other indication which shows where the user should use the male element to puncture the wall of the bag. This indication may also be formed by the externally visible contour of the join, which is often a welded or glued seam, between the wall of the bag and the body of the female element.

If printing is used to indicate the location where the male element should be inserted, it is preferable for this printing already to have been applied to the material of the wall before the female element is applied to the said material. The printing can then serve as a positioning feature for correctly positioning the female element with respect to the material of the wall of the bag. If a large number of bags are to be made from a preprinted web of sheet, the printing indicating the location for the female element can also be used to ensure that the bag is of the correct dimensions, for example by using positioning means associated with separation means which divide the sheet web into parts which are each formed into a single bag to detect the printing.

In a further variant, which makes it clear where the wall of the bag should be punctured and helps the user with correct puncturing of the wall, it is provided that a second female element with a bore in line with the bore in the female element arranged against the inner side of the wall is arranged against the outer side of the wall of the container, it being possible for the male element to be fitted from the outside into the second female element.

In a further variant, it is provided that the male element is already prefitted displaceably in the second female element, so that the user only has to slide the male element in the direction of the bore in the other female element, the intervening wall of the bag being punctured in the process.

In the dispensing system, it is further possible for a direct lock to be produced between the male element and the body of the female element with the aid of locking means which are designed for this purpose and may optionally be actuated by a user.

The locking means preferably form a stop face on the body of the female element and a stop face on the male element, which stop faces engage behind one another in the locked position. This may be a type of bayonet coupling but may also a threaded coupling or a coupling with a resilient grip edge or resilient lips.

In a preferred embodiment, the said locking means define a plurality of axial positions of the male element with respect to the body of the female element, which positions comprise at least a first position, in which the closure element closes off the bore, and a second position, in which the closing action of the closure element is eliminated. This measure makes it possible for the male element, while not yet engaging on the closure element, for example not yet being coupled to the plug, still to be connected via the locking means to the body of the female element, so that it cannot inadvertently come out of the bore.

The invention will be explained in more detail below with reference to the drawings therefore:

BRIEF DESCRIPTION OF THE DRAWINGS

FIG. 2 shows a diagrammatic cross section through the female element, which is arranged on the inner side of the wall of the bag shown in FIG. 1, with an associated plug and the associated male element before the wall of the bag has been punctured, and.

DETAILED DESCRIPTION OF THE INVENTION

Figure 1:
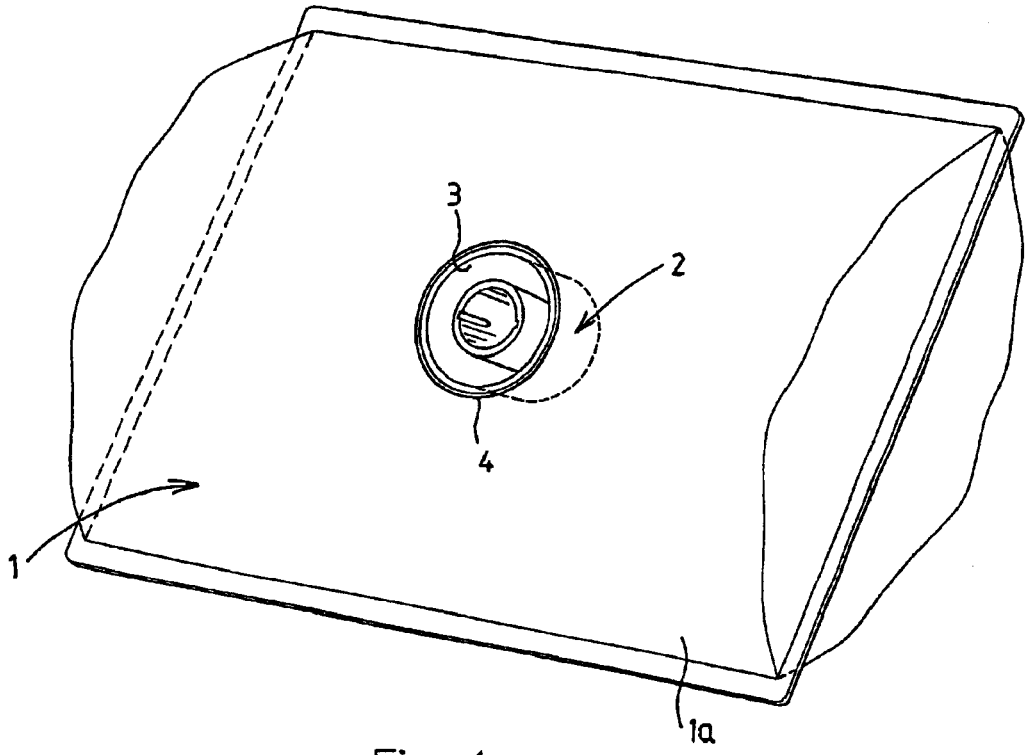
FIG. 1 diagrammatically depicts a perspective view of a bag according to the invention.

FIG. 1 shows a bag 1 with an internal closed chamber which is filled with a substance which is to be dispensed from the bag 1. In this example, it has been assumed, for the sake of clarity, that the wall 1*a* of the bag 1 is made from a transparent plastic sheet. In practice, the bag 1 may be filled with all kinds of very diverse substances, such as liquids, soaps, oils, gases, creams, (fine) powder, toners, ink, etc.

On the inner side of its flexible wall, the bag 1 is provided with a female element 2 with a relatively rigid plastic body 3 which is produced, for example, by injection-moulding and is welded securely against the inner side of the wall 1*a* of the bag 1, along the peripheral weld seam 4.

The female element 2 has a bore 5 which extends through the body 3, which bore 5 extends from an insertion opening 6, which is covered in a sealed, manner by the wall 1*a* of the bag 1, for a male element 20, which is to be explained in more detail, in the vicinity of the wall 1*a* of the bag to an opening 7 in the chamber of the bag 1.

The bore 5 is also closed off, at a distance from the insertion opening 6, in this case in the vicinity of the opening 7, by a closure element which is designed as a plug 8. The plug 8 is held in a sealed manner in a seat 9, which extends around the bore 5, for the plug 8. The plug 8 resting in its seat 9 closes, off the bore 5, so that the substance in the bag 1 cannot enter the bore 5.

In this embodiment, the plug 8 is movably connected to the body 2, in this example via arms 10 which are integral with the plug 8 and the body 2.

As a result of the male element 20 being inserted through the wall 1*a* and into the bore 5, the plug 8 can be moved out of the associated seat 9 into an open position (cf. FIG. 3), in which substance can be dispensed from the bag 1.

The male element 20 is designed to puncture that part of the wall 1*a* of the bag 1 which covers the insertion opening 6 from the outside and then to enter the bore 5 in the female element 2, and then to interact with the plug 8 so as to move the plug 8 out of its seat 9, resulting in a connection with the chamber of the bag.

The male element 20 is provided with a tubular part 21 with an internal passage 22 for the substance which is to be dispensed. The male element 20 also has a head 23 which can puncture that part of the wall which covers the insertion opening 6 and can then interact with the plug 8 in order to press it out of its seat 9.

The plug 8 is in this case provided with an insertion cavity 12 for the head 23 of the male element 20, in such a manner that the head 23 firstly enters the insertion cavity 23 and is thus coupled to the plug 8 before the plug 8 comes out of its seat 9. When the male element 20 is pushed further into the bore 5, the plug 8 comes out of the bore 5 and the substance can enter the passage 22 via openings 24, behind the head 23, in the male element 20.

The coupling is such that, if the male element 20 is pulled back out of the bore 5, the plug 8 is returned to its seat 9 and the bag 1 is closed again. The male element 20 is then uncoupled from the plug 8.

Figure 3:
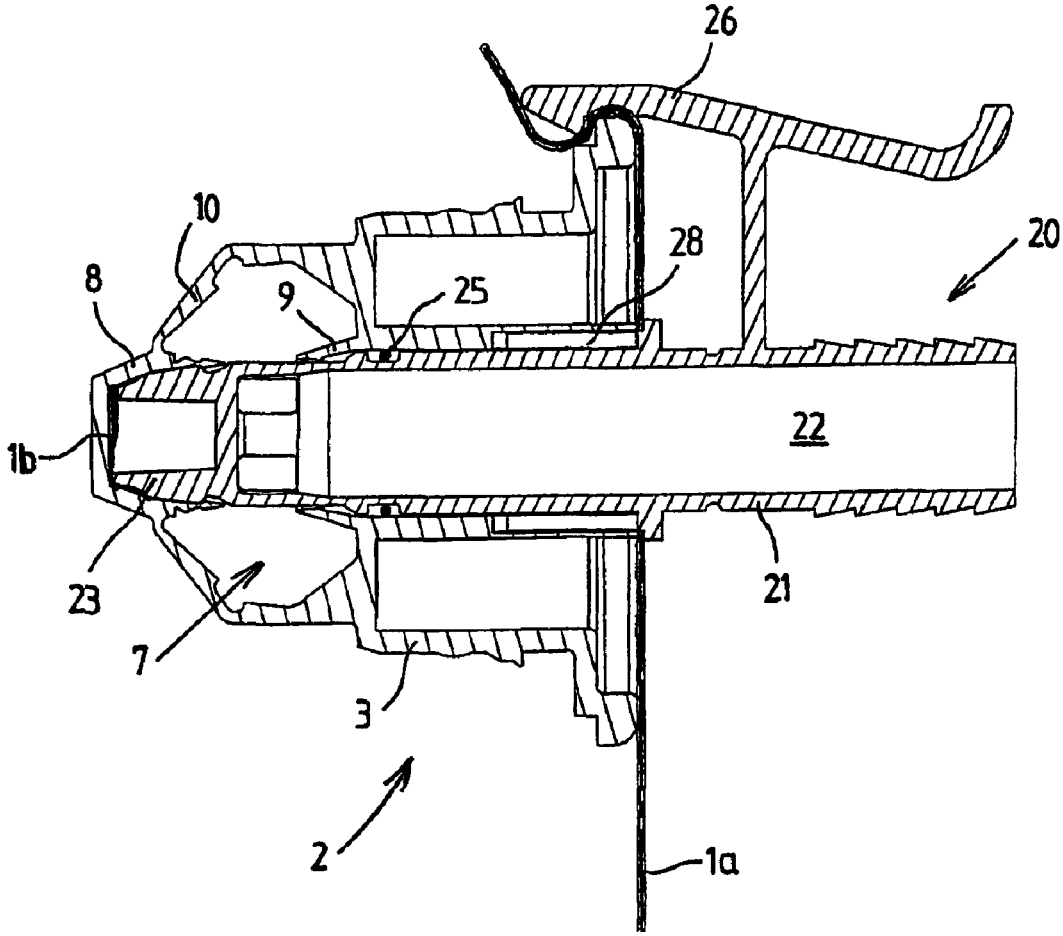
FIG. 3 shows another diagrammatic cross section, illustrating the female element, which has been arranged on the inner side of the wall of the bag shown in FIG. 1, with associated-plug and the associated male element after the wall of the bag has been punctured and the plug has been coupled to the male element and has been pushed out of its seat.

It can be seen in FIG. 3 that a section 1*b* of the material of the wall 1*a* of the bag 1 tears off when the wall 1*a* is punctured and is carried along by the head 23 of the male element 20. It should be noted that it may also be the case that this section 1*b* does not tear off. The torn-off section 1*b* is then clamped within the head 23, so that this part 1*b* cannot enter the substance.

Figure 2:
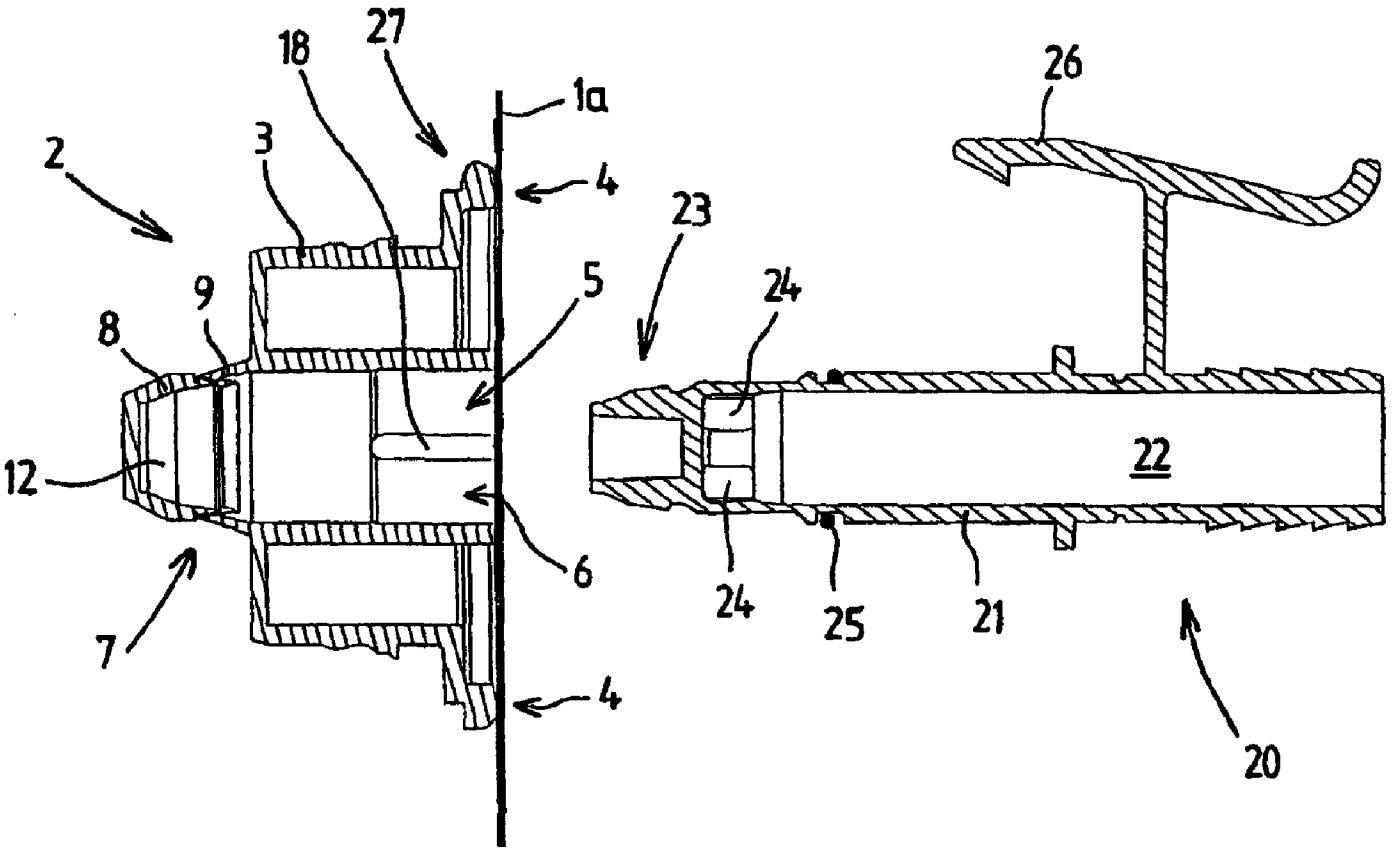

FIGS. 2 and 3 show a sealing ring 25 which is arranged in a circumferential groove of the male element 20. The effect of this sealing ring 25 is that—when the male element is inserted—a seal is created between the male element 20,and the female element 2 before the closure of the bore 5 produced by the plug 8 is eliminated, thus preventing the substance from leaking.

Furthermore, an actuable locking hook 26, which is intended to releasably lock the male element 20 which has been fitted into the bore 5 with respect to the female element 2, is arranged on the male element 20.

In this example, there is provision for the locking hook 26 to engage, by means of its hook edge, behind an outermost circumferential edge 27 of the body of the female element 2, so that the material of the wall 1*a* of the bag 1 comes to lie between the said locking hook 26 and the circumferential edge 27. In another variant (not shown), the locking hook 26 engages on the body of the female element 2 inside the contour of the weld seam 4. A completely different design of the locking means may also be provided.

In a practical embodiment (not shown), it is possible for one or more outwardly projecting hook stops to be provided on the outer circumference of the male element 20, these hooks, in the position shown in FIG. 3, engaging behind the body of the female element, in particular behind the projecting collar which is formed by the seat 9. The coupling which is then produced may, depending on the shape of the said hook stop, be such that the male element 20 cannot be pulled out of the bore 5.

Furthermore, FIGS. 2 and 3 show axial ribs 28 which are formed on the male element and grooves 18 which extend axially along the bore 5. If the male element 20 is inserted into the bore 5, the ribs 28 enter the grooves 18.

In a variant which is not shown, there is provision for a second female element to be arranged on the outer side of the wall of the bag, with a bore in line with the bore in the female element arranged against the inner side of the wall, it being possible for the male element to be fitted into the second female element from the outside or already to be prefitted therein.

The bag 1 described above may also be advantageous in the unfilled state, namely during the (aseptic) filling of the bag 1. This is because the bag 1 can be sterilized in the empty and closed state, for example using (gamma) radiation. Then, preferably under aseptic conditions, a male element 20, which is designed as a filling member, punctures the wall of the bag 1 at the location of the female element 2 which is present in the bag, so that the filling member enters the bore 5 and couples the plug 8 to the head 23 of the male element and then pushes it off its seat, after which the bag is filled with the substance via the male element. When the bag is full, the filling member is moved out of the bore, 5, the plug 8 being returned to its seat, so that the plug closes off the bore 5, after which the plug is uncoupled from the head of the filling member 20. If appropriate, an additional seal is then arranged over the punctured part of the wall of the bag 1.

What is claimed is:

1. A bag with a flexible wall which delimits a closed chamber of the bag for a store of a substance, said wall having an inner side, wherein a female element with a body through which a bore extends is attached to the inner side of the wall of the bag, which bore extends from an insertion opening for a male element, which is covered in a sealed manner by the wall of the bag, in the vicinity of the wall of the bag, to an opening into the chamber of the bag, the bore also being closed off, at a distance from the insertion opening, by a closure element, in such a manner that a male element can puncture that part of the wall of the bag which covers the insertion opening from the outside, so that the male element then enters the bore of the female element and as the male element is inserted further into the bore—then interacts with the closure element and eliminates the closure of the bore which is provided by the closure element.

2. A bag according to claim 1, in which the closure element is designed to give way under the influence of the male element being fitted into the bore.

3. A bag according to claim 1, wherein the closure element comprises a puncturable or tearable membrane.

4. A bag according to claim 1, in which the closure element is a plug which is accommodated in a sealed manner in a seat which extends around the bore and is delimited by the female element, which plug, under the influence of the male element being inserted into the bore, can be moved out of the associated seat into an open position in which the bore is open.

5. A bag according to claim 4, in which the plug is also coupled, in its open position, to the body of the female element.

6. A dispensing system comprising, in combination:

a bag with a flexible wall which delimits a closed chamber of the bag for a store of a substance, said wall having an inner side, wherein a female element with a body through which a bore extends is attached to the inner side of the wall of the bag, which bore extends from an insertion opening for a male element, which is covered in a sealed manner by the wall of the bag, in the vicinity of the wall of the bag, to an opening into the chamber of the bag, the bore also being closed off, at a distance from the insertion opening, by a closure element, in such a manner that a male element can puncture that part of the wall of the bag which covers the insertion opening from the outside, so that the male element then enters the bore of the female element and—as the male element is inserted further into the bore—then interacts with the closure element and eliminates the closure of the bore which is provided by the closure element, and an associated male element which, from the outside, can puncture that part of the wall which covers the insertion opening and then enters the bore of the female element, and then interacts with the closure element in order to eliminate the closure of the bore provided by the closure element, so that a connection is created to the chamber of the bag.

7. A dispensing system according to claim 6, in which the male element is provided with one or more internal passages for the substance which is to be dispensed, and in which the male element and the female element are designed in such a manner that—when the male element is inserted—a seal is produced between the male element and the female element before the closure of the bore provided by the closure element is eliminated, so that leakage of substance is prevented.

8. A dispensing system according to claim 6, in which the male element has a head which can puncture that part of the wall which covers the insertion opening and can then interact with the plug in order to push it off its seat.

9. A dispensing system according to claim 6, in which the male element has a head which can puncture that part of the wall which covers the insertion opening and can then interact with the plug in order to push it off its seat, and in which the plug and the head of the male element are designed in such a manner that the plug can be coupled to the head of the male element.

10. A dispensing system according to claim 6, in which the male element has a head which can puncture that part of the wall which covers the insertion opening and can then interact with the plug in order to push it off its seat, and in which the plug and the head of the male element are designed in such a manner that the plug can be coupled to the head of the male element, and in which the plug is provided with an insertion cavity into which the head of the male element fits.

11. A dispensing system according to claim 6, in which the male element is provided with locking means which are designed to lock the male element which has been inserted into the bore with respect to the female element.

12. Dispensing system according to claim 6, in which a second female element with a bore in line with the bore in the female element arranged against the inner side of the wall of the bag is arranged against the outer side of the wall of the bag, it being possible for the male element to be fitted from the outside into the second female element or already to be prefitted therein.

13. A method for producing a bag with a flexible wall which delimits a closed chamber of the bag for a store of a substance, said wall having an inner side, wherein a female element with a body through which a bore extends is attached to the inner side of the wall of the bag, which bore extends from an insertion opening for a male element, which is covered in a sealed manner by the wall of the bag, in the vicinity of the wall of the bag, to an opening into the chamber of the bag, the bore also being closed off, at a distance from the insertion opening, by a closure element, in such a manner that a male element can puncture that part of the wall of the bag which covers the insertion opening from the outside, so that the male element then enters the bore of the female element and—as the male element is inserted further into the bore—then interacts with the closure element and eliminates the closure of the bore which is provided by the closure element, in which method the wall of the bag is composed of one or more webs of sheet material which are formed into a bag by folding actions and welding operations, the female element being fixed to a sheet web, in such a manner that the bore in the female element is covered by the sheet web on the side of the insertion opening for the male element.

14. A method for filling a bag with a flexible wall which delimits a closed chamber of the bag for a store of a substance, said wall having an inner side, wherein a female element with a body through which a bore extends is attached to the inner side of the wall of the bag, which bore extends from an insertion opening for a male element, which is covered in a sealed manner by the wall of the bag, in the vicinity of the wall of the bag, to an opening into the chamber of the bag, the bore also being closed off, at a distance from the insertion opening, by a closure element, in such a manner that a male element can puncture that part of the wall of the bag which covers the insertion opening from the outside, so that the male element then enters the bore of the female element and—as the male element is inserted further into the bore—then interacts with the closure element and eliminates the closure of the bore which is provided by the closure element, in which method the starting point is an empty bag with a seam which is completely or partially left open, a filling member being introduced into the bag, preferably under aseptic conditions, via the part of the seam which has been left open, and the substance being introduced into the bag, after which the filling member is removed from the bag and the seam in question is closed, in particular by welding.

15. A method for filling a bag with a flexible wall which delimits a closed chamber of the bag for a store of a substance, said wall having an inner side, wherein a female element with a body through which a bore extends is attached to the inner side of the wall of the bag, which bore extends from an insertion opening for a male element, which is covered in a sealed manner by the wall of the bag, in the vicinity of the wall of the bag, to an opening into the chamber of the bag, the bore also being closed off, at a distance from the insertion opening, by a closure element, in such a manner that a male element can puncture that part of the wall of the bag which covers the insertion opening from the outside, so that the male element then enters the bore of the female element and—as the male element is inserted further into the bore—then interacts with the closure element and eliminates the closure of the bore which is provided by the closure element, in which method the starting point is an empty bag with a hermetically sealed chamber, a male element which is designed as a filling member puncturing the wall of the bag, preferably under aseptic conditions, at the location of the female element which is present in the bag, so that the filling element enters the bore and couples the plug to the head of the male element and then pushes it off its seat, after which the bag is filled with the substance via the male element, and then the filling member is moved out of the bore, the plug being moved back into its seat, so that the plug closes off the bore, after which the plug is uncoupled from the head of the filling member, and then, if appropriate, an additional seal is applied over that part of the wall of the bag which has been punctured.

16. A method according to claim 15, in which, before being filled, the bag is subjected to a sterilization treatment, for example using gamma radiation, and in which the bag is filled in a sterile space.

* * * * *

UNITED STATES PATENT AND TRADEMARK OFFICE

CERTIFICATE OF CORRECTION

PATENT NO. : 6,871,679 B2
DATED : March 29, 2005
INVENTOR(S) : Laurens Last

It is certified that error appears in the above-identified patent and that said Letters Patent is hereby corrected as shown below:

Column 10,
Lines 15-16, delete "...the closure clement and…" and insert -- the closure element and --.

Signed and Sealed this

Fifth Day of July, 2005

JON W. DUDAS
*Director of the United States Patent and Trademark Office*